US005868146A

United States Patent [19]

Henninger et al.

[11] Patent Number: 5,868,146

[45] **Date of Patent: *Feb. 9, 1999**

[54] STYLING APPLIANCE AND METHOD OF STYLING HAIR

[75] Inventors: Friedrich Henninger, Kelkheim; Peter Janouch, Linsengericht; Dieter Liebenthal, Maintal, all of Germany

[73] Assignee: Braun Aktiengesellschaft, Kronberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 677,700

[22] Filed: Jul. 10, 1996

[30] Foreign Application Priority Data

May 10, 1996 [DE] Germany ..... 196 18 876.8

[51] Int. Cl.[6] ..... A45D 1/04

[52] U.S. Cl. ..... 132/232; 132/269

[58] Field of Search ..... 132/227, 228, 132/229, 232, 234, 236, 268, 269; 219/222, 225, 226

[56] References Cited

U.S. PATENT DOCUMENTS

| | | | |
|---|---|---|---|
| 1,847,401 | 3/1932 | Klein . | |
| 1,857,689 | 5/1932 | Melkman | 219/225 |
| 1,887,786 | 11/1932 | Pryor | 132/228 |
| 1,943,889 | 1/1934 | Gentile | 132/228 |
| 2,103,676 | 12/1937 | Karasiewicz | 132/232 |
| 2,880,299 | 3/1959 | Jones | 132/232 |
| 3,420,246 | 1/1969 | Stageberg . | |
| 3,660,634 | 5/1972 | Scott . | |
| 3,735,768 | 5/1973 | Burney . | |
| 3,955,064 | 5/1976 | Demetrio et al. . | |
| 4,004,596 | 1/1977 | Hyland . | |
| 4,163,143 | 7/1979 | Federico et al. . | |
| 4,166,473 | 9/1979 | Bauer et al. . | |
| 4,214,597 | 7/1980 | Glassman | 132/269 |
| 4,243,017 | 1/1981 | Diederich . | |
| 4,248,208 | 2/1981 | Diederich . | |

(List continued on next page.)

FOREIGN PATENT DOCUMENTS

| | | | |
|---|---|---|---|
| 124461 | 9/1931 | Austria . | |
| 077 600 | 4/1983 | European Pat. Off. . | |
| 0 021 224 B1 | 8/1987 | European Pat. Off. . | |
| 273 538 | 7/1988 | European Pat. Off. . | |
| 82 19582 | 5/1983 | France . | |
| 2533424 | 3/1984 | France . | |
| 1 457 438 | 12/1970 | Germany . | |
| 77 26 353 | 12/1977 | Germany . | |
| 32 15 232 | 10/1983 | Germany . | |
| 233070 | 2/1986 | Germany | 219/225 |
| 25 60 125 | 11/1986 | Germany . | |
| 6-253922 A | 9/1994 | Japan . | |
| 243 634 | 12/1925 | United Kingdom . | |
| 285982 | 2/1928 | United Kingdom . | |
| 504 334 | 4/1939 | United Kingdom . | |
| 1 524 929 | 9/1978 | United Kingdom . | |
| 2224437 | 5/1990 | United Kingdom | 219/225 |

OTHER PUBLICATIONS

Patent Abstracts of Japan of Patent JP 6 253922 A, vol. 18, No. 648, dated Aug. 12, 1994 (1pp).

*Primary Examiner*—Jeffrey A. Smith
*Assistant Examiner*—Eduardo C. Robert
*Attorney, Agent, or Firm*—Edward S. Podszus

[57] ABSTRACT

The invention is directed to a hair styling appliance and a method of styling hair, using in particular the hair styling appliance. The hair styling appliance is comprised of a handle portion, a heating portion (6) for heating the hair, and a pressure-generating clamp (8) for the generation of a contact pressure acting on the hair to be styled, the hair being adapted to be introduced between the heating portion (6) and the pressure-generating clamp (8). In this arrangement, a styling edge (10) is provided in the area of the heating portion (6) and/or the pressure-generating clamp (8) of the appliance, which styling edge has a cross-section of arcuate, in particular circular-arc shape, of polygonal or similar shape.

67 Claims, 8 Drawing Sheets

U.S. PATENT DOCUMENTS

| | | | |
|---|---|---|---|
| 4,341,229 | 7/1982 | Bauer et al. . | |
| 4,456,815 | 6/1984 | Andis | 132/232 |
| 4,468,554 | 8/1984 | Andis | 219/222 |
| 4,479,047 | 10/1984 | Khaja et al. | 132/232 |
| 4,565,916 | 1/1986 | Tsuji et al. . | |
| 4,953,574 | 9/1990 | Tsuji et al. . | |
| 5,400,809 | 3/1995 | Adams | 132/232 |

STYLING APPLIANCE AND METHOD OF STYLING HAIR

FIELD OF THE INVENTION

This invention relates to a hair styling appliance having a handle portion, a heating portion for heating the hair, and a pressure-generating means for the generation of a contact pressure acting on the hair to be styled, the hair being adapted to be introduced between the heating portion and the pressure-generating means. The present invention further relates to a method of styling hair, using in particular the hair styling appliance of the present invention.

DESCRIPTION OF RELATED ART

A multiplicity of appliances and methods of the aforementioned type are known in the art. Thus, for example, EP 0 021 224 B1 discloses a hair treating appliance in the form of a gas-powered curling iron. This curling iron is comprised of an elongate handle portion and an adjoining heating portion. The handle portion is further provided with a pressure-generating means in the form of a pivotal hair retaining clamp. For styling the hair, in particular for curling or waving hair, the end of a strand of hair, that is, the tips of hair, is inserted between the hair winding portion and the hair retaining clamp and clamped in position. In a subsequent operation, the strand of hair is wrapped around the heated hair winding portion from the tips down to the root level of the hair. After allowing the hair to set for some time, the hair retaining clamp is lifted clear of the hair winding portion, and the curled or waved strand of hair is withdrawn from the hair winding portion.

From DE 32 15 232 A1 a further method of styling a strand of hair by the action of heat and a hair styling appliance therefor are known. In this specification, part of the air produced by a fan is delivered through a heating coil to a hot air chamber of a cylindrical winding portion and is discharged through radial hot air outlet openings. A bypass channel arranged to extend past the heating coil directs cooling air into a cooling air chamber of the hair winding portion. The strand of hair to be shaped is placed around the winding portion which is then moved away from the scalp, with the strand of hair first sliding over the outer wall of the hot air chamber and then over the outer wall of the cooling chamber. As this occurs, the strand of hair is first heated and then cooled in immediately successive sequence, thereby maintaining its wavy and/or curly shape imparted to it by the outer wall of the hot air chamber.

In the hair styling appliances known in the art, the diameter of the heated hair winding portion determines the type or shape of the curls, in particular the size of the curls that can be obtained.

SUMMARY OF THE INVENTION

It is therefore an object of the present invention to provide, in an improvement over the prior art, a hair styling appliance and a method, in particular for applying the hair styling appliance, which allows the shaping of curls, with the diameter of the curls and thus the type or shape of curl being producible independently of the diameter of the hair winding portion. Further, it is desirable that the curl or wave thus created with the strand of hair be made to last as long as possible.

According to the present invention, this object is accomplished by a hair styling appliance, in which a styling edge or ridge is provided in the area of the heating portion and/or the pressure-generating means of the appliance. With this configuration of a styling edge, a means is provided which affords the advantage that the type or shape of curl is variable in a simple manner, and which is independent of the geometry of the hair winding portion or the heating portion. The essentially arcuate cross-section of the styling edge is particularly advantageous for the styling of the hair. In particular, this arcuate cross-section may be in the manner of the arc of a circle having a defined radius over which the strand to be shaped is pulled; considering that also a polygonal cross-section may be considered as approximately arcuate, it is advantageously also possible to have a styling edge which is polygonal or similar in cross-section.

While advantageously, the configuration of the heating portion may thus be of any desired geometry, it should nevertheless be ensured that a good heat transfer can be effected from the heating portion to the hair to be styled. The heating portion may be heated either by gas or electrically, and it should allow heating of the hair to at least a temperature suitable for hair styling.

With the pressure-generating means, a contact pressure is exerted on the hair to be styled which is insertable between the heating portion and the pressure-generating means. For one purpose, a good heat transfer is accomplished from the heating portion to the Hair, and for another purpose, a clamping force is applied to the hair to be styled. Acting as a retaining force, this clamping force counteracts the pull with which the user moves the hair styling appliance relative to the hair.

The hair styling appliances known in the art, in particular curling irons, are conventionally equipped with hair retaining clamps. These clamps include, of course, also lateral edges;

their geometrical configuration is, however, without particular significance in the art, because these clamps merely hold the hair against the hair winding portion. The only decisive feature is that the surface of the hair retaining clamp associated with the heated hair winding portion is shaped such as to establish good contact between the hair winding portion and the clamp.

In a particularly advantageous configuration of the styling edge, a radius greater than 0.1 mm is proposed, lying in particular between 0.5 mm and 5 mm. It will be understood, of course, that this configuration not only requires that a circular-arc shape as such be associated with a corresponding radius, but also that it involves a polygonal or similar shape with a dimension greater than 0.1 mm comparable to the radius. Styling aids with a radius of, for example, 0.5 mm advantageously result in small-diameter curls, whereas radii of, for example, 3 mm produce large-diameter curls. Styling edges with a radius greater than 5 mm do not produce curls, but rather, create waves in the hair. By providing the styling edge with a radius greater than 0.1 mm, a reversible hair shaping function is advantageously accomplished without causing damage to the hair which would be the case, for example, if the styling edge were sharp.

In a further feature of the present invention, the styling edge is arranged substantially parallel to the main axis of the hair styling appliance. This feature is based on a substantially rectilinear styling edge. Advantageously, this feature provides an efficient and structurally simple arrangement of the styling edge. Also, the pressure-generating means and the heating portion extend equally in a substantially longitudinal direction. However, it will be understood that other configurations of the pressure-generating means and the heating portion are also possible.

The tangents of the styling edge are arranged such as to intersect at an angle smaller than 180°. For one purpose, a small deflection of the hair is created when it is pulled over a styling edge at an obtuse angle of, for example, 15020 . In a configuration in which the styling edge has an acute angle of, for example, 30°, the hair to be shaped is advantageously deflected to a significant extent when it is pulled over the surface of the styling edge. The tangents of the styling edge may also enclose an angle of 0°, that is, they may be arranged parallel to each other, when the styling edge is disposed, for example, at the end of a narrow strip of sheet metal and is semicircular in cross-section.

The styling edge itself may be provided on the pressure-generating means which is configured as an essentially known styling clamp. Advantageously, a simple arrangement of the styling edge is thereby proposed requiring no further means on the hair styling appliance than those that are already provided. The styling clamp is configured in particular as a styling clamp movable relative to the handle and/or the heating portion and is movably connected with the handle portion as by a rotary joint known per se.

In a still further feature of the present invention, the styling edge is provided on the heating portion which may be configured, for example, as a heating portion integral with the styling edge. This thus advantageously reduces the number of necessary components to a minimum in that it requires only a single component for both heating and styling the hair.

In a particular configuration, the heating portion has an elliptical, tear-shaped or similar cross-sectional area. By varying the styling edge at the tapered end of the tear-shaped cross-sectional area, various angles of wrap of the strands of hair can be accomplished on the heating portion, advantageously resulting in various shapes and sizes of curl.

In a further feature of the present invention, it is proposed providing the styling edge on a separate styling means. This is an advantage in cases where, for example, a special shape of curl is desired.

In this feature, the separate styling means may advantageously comprise the pressure-generating means, in particular a retaining clamp and/or a cooling member. As a result, these two components may be configured as a subassembly suitable for attachment to the handle portion or the heating portion. Advantageously, this subassembly may have its one end connected to the handle portion or the heating portion by a rotary joint, in particular a spring-loaded rotary joint similar to a hair retaining clamp known in the art, thus enabling the hair to be readily inserted between the heating portion and the pivotal styling means.

In a particular embodiment of the present invention, a cooling member for cooling the styled hair is provided, which cooling member is arranged in particular in the area of the styling edge. Advantageously, it is thereby possible to obtain a particularly enduring curl shape in that the hair, following styling, is cooled on the cooling member, "freezing" the curls.

By arranging the heating portion, the styling edge and/or the cooling member essentially parallel to each other, these components may be advantageously disposed in a close spatial relationship to each other. This thus provides a short length of travel of the hair to be styled from the heating portion through the styling edge to the cooling member, enabling the curls to be set well.

Arranging the heating portion and the cooling member in a relatively spaced relationship to each other results in the advantage that a warm and a cold zone of the hair styling appliance can be provided separately without the two temperature zones mutually affecting each other a great deal.

In a particular configuration, the cooling member is made of a material conducting heat well as, for example, aluminum or a similar material, or it is comprised of a hollow body of aluminum filled with paraffin. Advantageously, a good cooling effect of the cooling member is thereby proposed for effective cooling of the previously heated hair following styling, that is, "freezing" the curls.

To enhance the cooling effect, it is proposed providing the cooling member with a heat-conducting coating and/or cooling ribs. This advantageously ensures a good dissipation of heat of the cooling member.

In a particular embodiment, the cooling member is configured as an actively coolable cooling member. This may be accomplished, for example, by means of cooling air which may be generated in the handle portion of the hair styling appliance. Alternatively, the cooling action may also be created by a Peltier element or a similar device. This advantageously results in a more intense cooling of the previously heated curls, thus producing a more enduring curl.

In another feature of the hair styling appliance, the heating portion and/or the styling means are provided with guiding and/or spacing means on the outside. These means are configured in particular as ribs advantageously allowing guiding of the strands of hair adapted to be wound about the forward part of the appliance for one purpose, while for another purpose acting as spacing means to protect the user from contact with the warm surface of the heating portion.

The ribs are arranged essentially transversely to the main axis of the appliance, so that between each two adjacent ribs a channel extending over the circumference of the heating portion and/or the styling means is formed, in which channel the strand of hair to be shaped is advantageously receivable with ease.

At least one rib of the hair styling appliance is provided as a boundary rib, so that the strand of hair guided around the heating portion and/or the styling means is advantageously secured by this rib against slipping off from the heating portion and/or the styling means.

In a particular configuration of the hair styling appliance, the two outermost ribs are configured as boundary ribs protruding at least in areas beyond the remaining ribs on the heating portion and/or the styling means in a plane transverse to the main axis of the appliance. As a result, a guiding function is effected on the strand of hair adapted to be placed around an area of the hair styling appliance, preventing the strand from slipping over the tip in a forward direction and over the handle portion of the appliance in a rearward direction.

Preferably, the ribs are provided on at least one component, in particular the heating portion, in an arcuate, undulating or arrow-shaped configuration. This rib configuration has the advantage that the strand of hair adapted to be guided around this particular component experiences greater friction than on the other component, in particular the styling means. This effect is intended to prevent the user from pulling the strand of hair over the outer side of the heating portion.

In a particular feature, these ribs are arranged on the heating portion substantially parallel to the main axis of the appliance. Advantageously, this is intended to confront the user with both a visual and a mechanical obstacle, in particular due to an increased frictional resistance, thereby preventing the user from pulling the hair over the outer side of the heating portion.

In a further feature of the present invention, the pressure-generating means, in particular the clamp, is pivotally mounted on the styling means. This provides a further possibility of movement of the clamp, advantageously enabling a compensating movement to be accomplished between the clamp and the heating portion.

In this arrangement, the pivot axis of the clamp is arranged substantially parallel to the longitudinal axis of the cooling member and/or the heating portion and thus also substantially parallel to the main axis of the appliance. Advantageously, this enables the clamp to have both its ends pivotally mounted in the cooling member by means of pivot pins. This results in an advantageously uniform contact pressure of the hair over the entire contact surface of the heating portion.

Still further, the clamp is configured essentially in mirror symmetry as seen in a plane transverse to its longitudinal axis, and the pivot axis preferably lies in this plane of symmetry. Advantageously, this makes it possible for the clamp to perform a uniform pivotal movement to either side of the plane of symmetry.

In a particular configuration of the present invention, it is proposed providing the appliance, in particular the handle portion, with a substantially elliptical, oval or similar outer contour in a plane normal to its main axis. Such a configuration of the gripping shell results in the advantage that the handle rests better in the user's hand, causing the user to feel uncomfortable when turning the hair styling appliance about its longitudinal axis. This configuration of the handle portion is intended to further support the novel manipulation of this appliance which differs noticeably from the use of hitherto known hair styling appliances to the extent that the appliance, rather than being turned about its longitudinal axis, is pulled away from the scalp using a straight-line motion.

In a further feature, it is proposed providing the heating portion and the styling means with a substantially constant area of cross-section along the main axis of the appliance, this area of cross-section being smaller than the area of cross-section of the forward end area of the handle portion. Advantageously, this results in a clear separation between the hair treatment part including the heating portion and the styling means at the one end, and the handle portion at the other end. Moreover, the large surface area of the handle portion gives the user a good, firm and sure grip.

The area of cross-section of the handle portion diminishes continuously from the forward to the rearward, free end of the handle, with the attendant advantage that this, too, enables the user to handle the appliance with a more comfortable, ergonomical grip.

In a particular embodiment of the present invention which may also be an invention in its own right, a method of styling hair is proposed in which the hair is insertable between a pressure-generating means and a heating portion of a hair styling appliance, and in which a clamping force is exerted on the hair to be shaped. In this embodiment, the hair is heatable to at least forming temperature which is also referred to as glass temperature $T_g$. According to the present invention, the heated hair is pulled over a styling edge or ridge, stretching in the process a longitudinal side of the hair. According to the present invention, this one-sided stretching of the hair allows the formation of an enduring curl. In this method, the curling effect is the greater, the greater the amount by which the hair is stretched. Still further, it is an advantage in the method herein proposed that the type and the size of the curls produced do not depend on the size, particularly the diameter, of a hair winding portion, but rather, solely on the one-sided stretching of the hair caused on the styling edge. In the process, the longitudinal sides of the hair close to the styling edge, that is, those sides of the hair that are directly pulled over the styling edge, are subjected to compressive stress, thus supporting the tensile stress occurring on the opposite longitudinal sides of the hair.

In a particularly advantageous embodiment of the present invention, the longitudinal sides of the hair facing away from the styling edge are stretched by at least one percent. This is an effective means of imparting curls to hair, independent of the diameter of a hair winding portion. The change to which hair is subjected as it is stretched up to an amount lower than about 30% is advantageously completely reversible, thus obviating the risk of damage to the hair as it is stretched over a styling edge.

For shaping curls, it is necessary that a relative motion take place between the heated hair and the styling edge. In the hair styling methods hitherto known, it is conventionally the loose ends of the hair that are clamped between the pressure-generating means and the heating means, followed by a movement from the hair ends to the root level, customarily by wrapping the hair on a hair winding portion. In contrast thereto, the present method allows a movement from the root level to the loose ends of the hair, with the heated hair being pulled over the styling edge during this movement, whereby advantageously an effective hair styling operation is accomplished from the root level to the tips of the hair.

The longitudinal sides of the hair close to the heating portion are pulled over and stretched on the styling edge, producing to advantage the curls desired by the user.

Alternatively, it is also possible for the longitudinal sides of the hair facing away from the heating portion to be deflected and stretched on the styling edge. Advantageously, this thus also allows the formation of hair curls.

For good curl formation, the hair is pulled over the styling edge in a tensioned condition. This is accomplished in that the hair is clamped between the pressure-generating means and the heating portion, whereby a holding force is exerted on the hair. This holding force counteracts the pull generated by the user by moving the hair styling appliance relative to the hair. This tensioned condition of the hair is advantageously conducive to the formation of curls.

The hair to be shaped is deflected on the styling edge in particular at an angle of between 5° and 180°, approximately. This advantageously results in a wide variety of curl shapes. Deflecting the hair on the styling edge about a small angle only, a weak curl formation is obtained, whilst a deflection by an angle greater than 90° and smaller than 180° enables a correspondingly stronger curl shaping operation to be accomplished.

The direction of movement of the hair downstream of the styling edge, that is, upon leaving the styling edge, is in the same direction as, or the opposite direction to, the direction of movement upstream of the styling edge, that is, prior to reaching the styling edge. A movement in the same direction up-stream and downstream of the styling edge allows a more uniform and advantageously lower pull of the hair; a deflection of the direction in which the hair is moved on a styling edge necessitates a higher pull, advantageously producing a tighter curl.

In a particular embodiment of the present invention, it is proposed cooling the hair following stretching by moving, in particular pulling, the curled hair along a cooling member. This advantageously enables the curls to be set well by "freezing".

A particularly good styling result is obtained in that the stretched longitudinal sides of the hair face away from the cooling member and are pulled around the cooling member in this position.

The curl shape is variable by the relative speed between the styling edge and the hair to be styled. Thus, guiding the appliance in a slow motion of the styling edge relative to the hair advantageously produces a tight curl, whilst a rapid guiding motion is adapted to produce a generous curl.

The surface temperature of the cooling member is lower than or equal to 85° C., whereby an enduring curl is obtained to advantage. Because the forming temperature of human hair is about 120° C. at about 30° relative humidity of air, a surface temperature of the cooling member of 85° C. or lower provides a temperature difference sufficient to ensure that the curls previously produced hold their shape sufficiently well.

The method of the present invention advantageously enables smooth hair to be effectively curled nearly from the root level to the tips of the hair, without utilizing a winding portion hitherto necessary for prior-art methods. Further, the hair forming operation obtainable with this method is reversible.

Further features, advantages and application possibilities of the present invention will become apparent from the subsequent description of embodiments illustrated in more detail in the accompanying drawings. It will be understood that any single feature and any combination of single features described and/or represented by illustration form the subject-matter of the present invention, irrespective of their summarization in the claims and their back-references.

DESCRIPTION OF THE PREFERRED EMBODIMENTS

Figure 1:
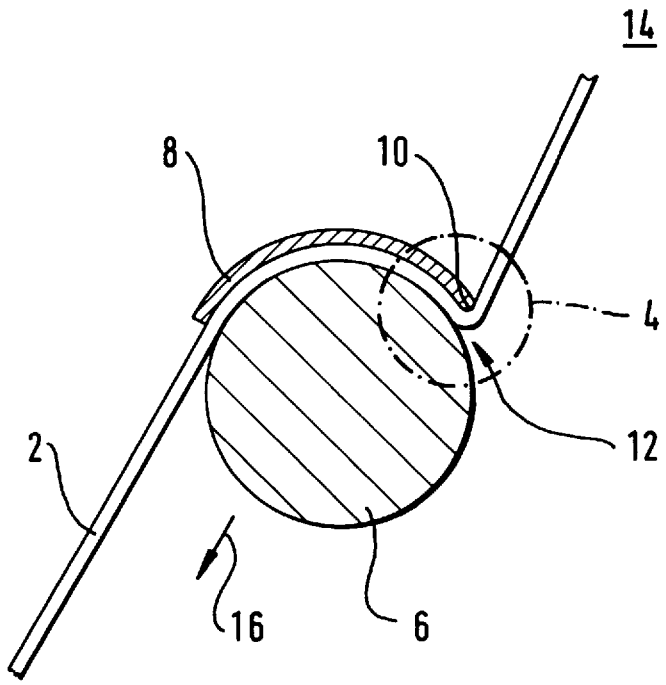
FIG. 1 is a cross-sectional view of a heating portion and a pressure-generating means having a styling edge of the present invention, and a strand of hair to be styled.

A hair styling appliance of the present invention (FIG. 1) is comprised of, for example, a circular-cylindrical heating portion 6 and a pressure-generating means, in particular a hair retaining clamp 8 which is urged against the heating portion 6 by a spring means not shown. Starting from root level 14, a strand 2 of hair to be styled is inserted between the heating portion 6 and the clamp 8, the heating portion 6 heating the strand of hair to forming temperature along the contact surface 12 between the two components. On its one edge, the clamp 8 has an elongate styling edge 10 over which the strand 2 is pulled. When the user moves the hair styling appliance in the direction of pull 16, the heated strand 2 is drawn through the area between the heating portion 6 and the clamp 8 and, upon leaving the contact surface 12, the strand 2 is deflected on the styling edge 10 of the clamp 8; this shapes the strand 2 of hair into a curl from root level 14 to the tips.

Figure 2:
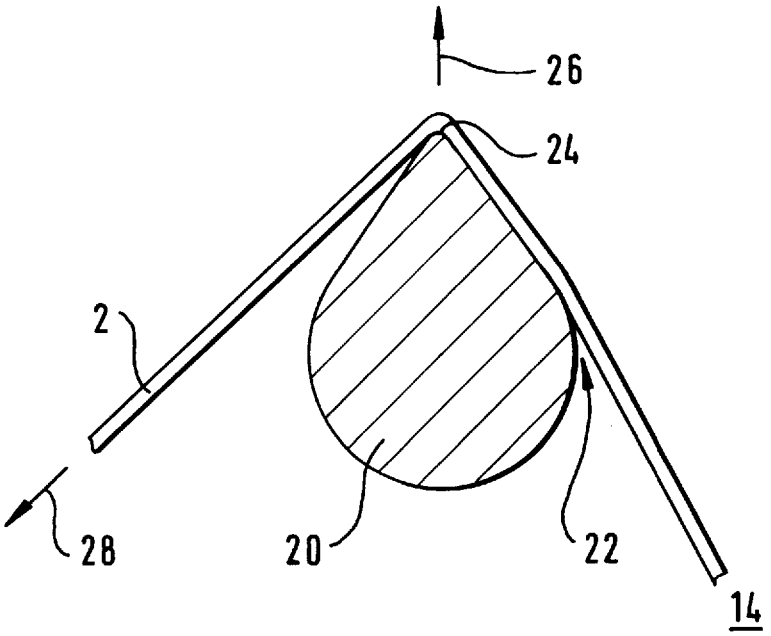
FIG. 2 is a cross-sectional view of a heating portion having a styling edge integrally formed thereon, and a strand of hair to be styled.

An alternative embodiment of a hair styling appliance of the present invention (FIG. 2) comprises an elongate heating portion 20 substantially tear-shaped in cross-section. On a longitudinal side thereof, this heating portion 20 has a styling edge 24. The strand 2 of hair to be shaped is heated from the root level 14 through the contact surface 22 of the heating portion 20 and deflected on the styling edge 24 by the user moving the heating portion 20 in the direction of movement 26. To accomplish this, the user is required to tension the strand 2 of hair in the direction of pull 28 in order for the strand 2 to experience the contact force on the contact surface 22 necessary for heating.

Figure 3:
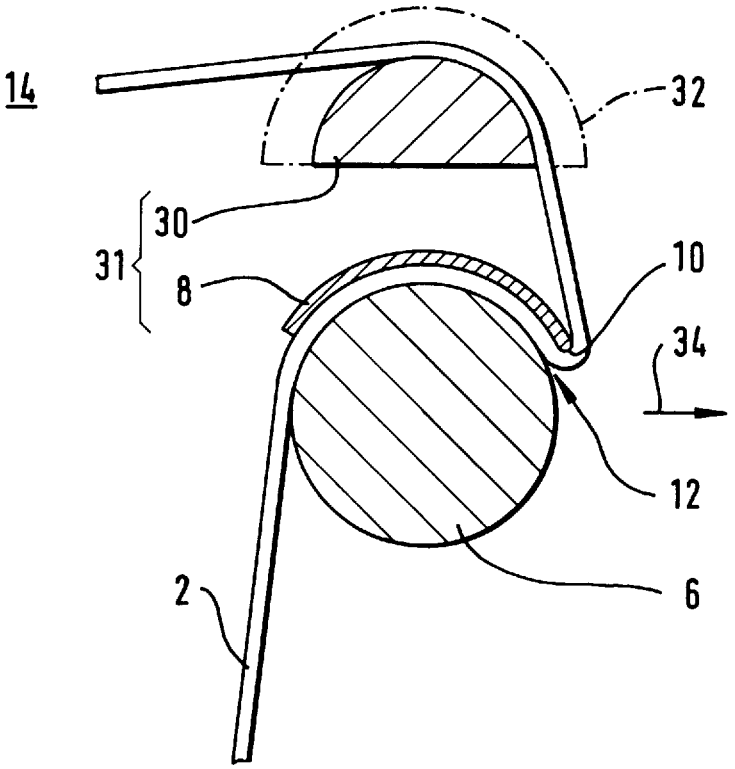
FIG. 3 is an arrangement similar to FIG. 1, but providing an additional cooling member.

Curls holding their shape particularly well are created by cooling the curls on a cooling member following shaping, "freezing" the curls. To this end, a hair styling appliance configured according to the representation of FIG. 1 is utilized, comprising a heating portion 6 and a clamp 8 with a styling edge 10. In this configuration, a cooling member 30 as shown in FIG. 3 may be arranged above the clamp 8 and attached to the clamp 8 by a connection not shown. The clamp 8 and the cooling member 30 combine to form a styling means 31. The cooling member 30 is semicircular in cross-section, and it may be equipped with cooling ribs 32 in its upper arcuate area for enhancing the cooling action. In this arrangement, the cooling member 30 extends equally in a longitudinal direction parallel to the heating portion 6 and the clamp 8. A movement of the hair styling appliance in the direction of movement 34 first involves heating of the strand 2 on the contact surface 12, then deflecting it on the styling edge 10, and subsequently cooling it on the cooling member 30.

Figure 4:
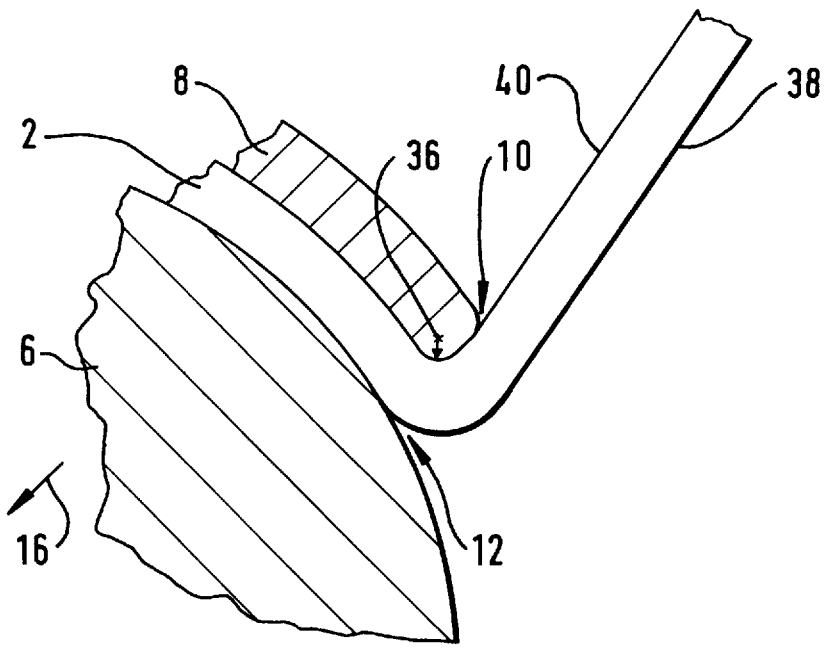
FIG. 4 is an enlarged view of a detail 4 of FIG. 1.

The strand 2 of hair (FIG. 4) is urged against the heating portion 6 by the clamp 8 in the area of the contact surface 12 and pulled around the styling edge 10 as the heating portion 6 is moved in the direction of movement 16. In the process, the strand 2 of hair is looped over the subsequent edge area of the clamp 8 providing the styling edge 10. Decisive for the styling result of the strand 2 of hair shaped to form a curl is the particular radius 36 of the styling edge 10. It should have a minimum radius of 0.1 mm, approximately, in order to prevent that the hair is destroyed, in particular broken, during shaping. The strand 2 of hair may be wrapped around the styling edge 10 at approximately right angles, as shown in FIG. 4; however, the angle of wrap of the strand 2 of hair relative to the styling edge 10 may also be greater or smaller than 90°, depending on the intended styling result, that is, whether small- or large-diameter curls are to be produced.

When the strand 2 of hair is pulled around the styling edge 10, the longitudinal side 38 of the hair close to the heating portion 6 is exposed to tensile stress, while the longitudinal side 40 of the hair facing away from the heating portion 6 is exposed to compressive stress. This difference in the variation of hair length produces the curls.

A hair styling appliance 50 of the present invention (FIGS. 5, 6 and 7) substantially comprises a handle portion 54 with a heating portion 52 and a styling means 72. The handle portion 54 in turn is composed of a central gripping shell 64, a forward cover 62, and an end cap 66 arranged symmetrically about the main axis 70. Controls 68 are provided on the upper and lower side of the handle portion. Between the forward cover 62 and the tip 56, the heating portion 52 is provided with ribs 58, each two adjacent ribs forming a circumferential channel 59 therebetween.

The ribs 76 of the styling means 72 are arranged substantially normal to the main axis 70, while the ribs 58 of the heating portion 52 have an arrow-shaped configuration pointing in the direction of the tip 56. Longitudinal ridges 60 are disposed on the heating portion 52 close to the parting line 74 between the heating portion 52 and the styling means 72.

The foremost and the rearmost rib of the styling means 72 is configured as a boundary rib 78 protruding beyond the styling means 72 at least in areas in the direction of the heating portion 52.

Figure 8:
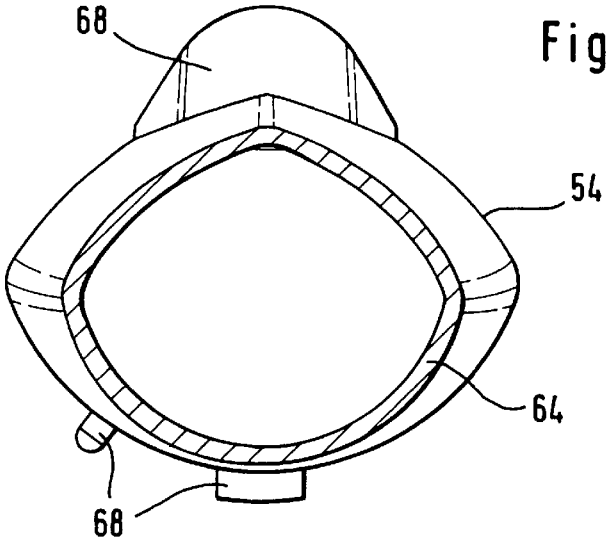
FIG. 8 is an enlarged sectional view of a handle portion, taken along the line 108 of FIG. 6.

The sections 108, 109 and 110 of FIG. 6 will be described in the following with reference to the subsequent Figures. A section 108 taken in the proximity of the end cap 66 (FIG. 8) shows the elliptical configuration of the handle portion 54. At this location, the gripping shell 64 has a smaller cross-sectional area than in the vicinity of the forward cover 62. In the interest of simplicity, the parts built into the gripping shell 64 are not shown. Provided on the upper and underside of the handle portion 54 are the controls 68 for turning the appliance on and off, as well as for operation of the styling means.

Figure 6:
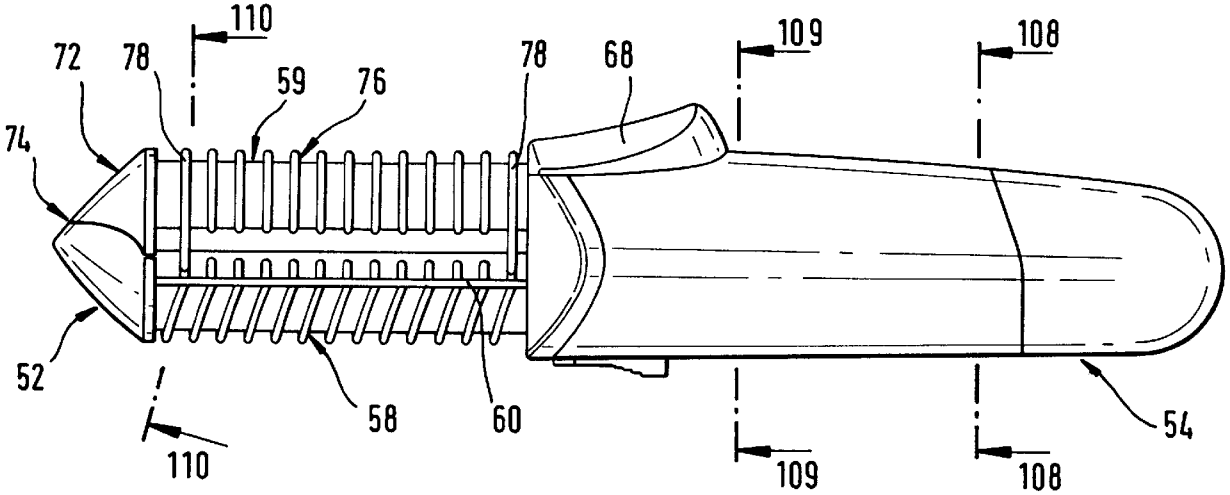
FIG. 6 is a side view of a hair styling appliance of FIG. 5 showing a styling means.
Figure 7:
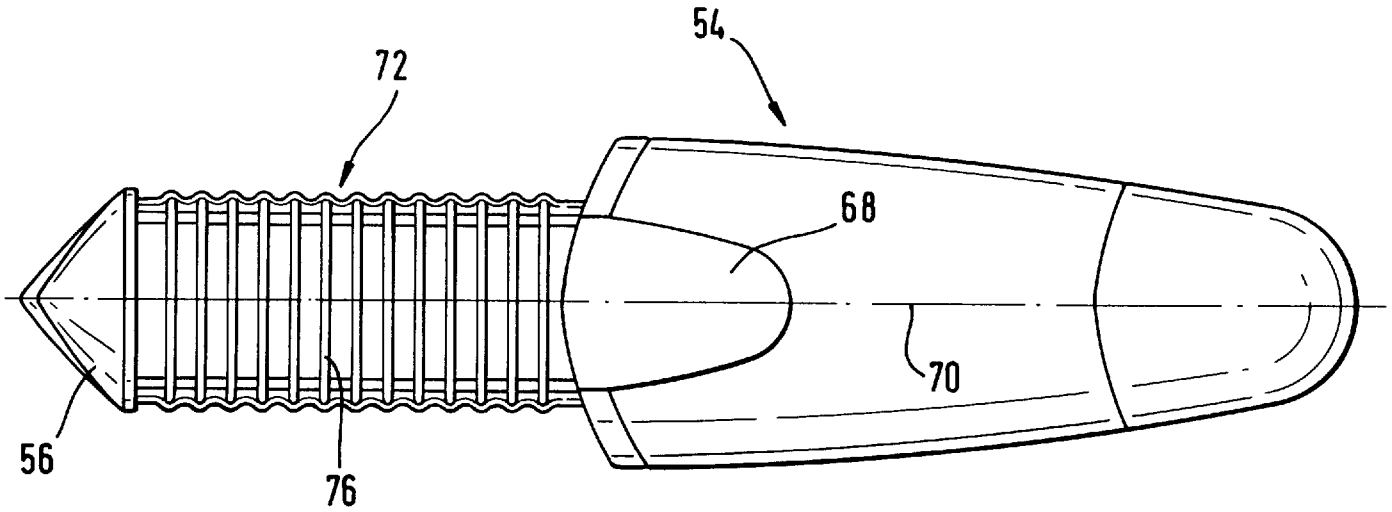
FIG. 7 is a top plan view of a hair styling appliance of FIG. 6.
Figure 9:
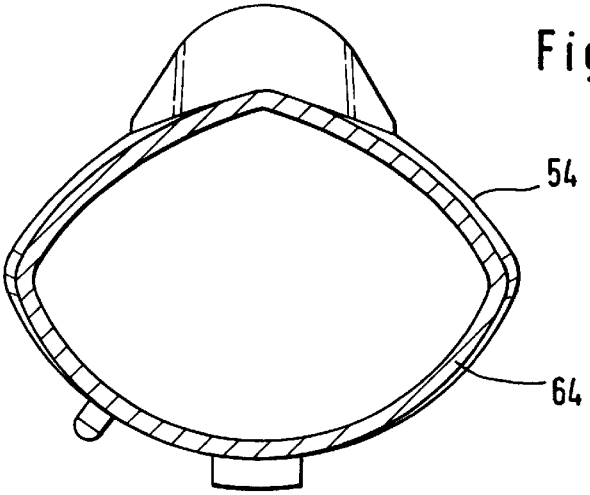
FIG. 9 is an enlarged sectional view of a handle portion, taken along the line 109 of FIG. 6.

In a section taken along the line 109 of FIG. 6, the gripping shell 64 (FIG. 9) shows a cross-sectional area larger than in the section 108, this area increasing progressively from the rearward end of the handle portion to the forward cover of the handle portion.

Figure 10:
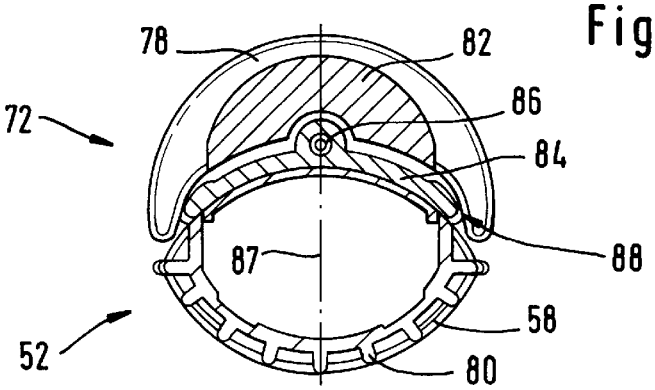
FIG. 10 is an enlarged sectional view of a heating portion and a styling means, taken along the line 110 of FIG. 6.

A section taken along the line 110 of FIG. 6 (FIG. 10) shows the lower heating portion 52 and the upper styling means 72. The heating portion 52 is surrounded by the ribs 58 which extend essentially in the circumferential direction and are connected, in the radial direction, with the inner area of the heating portion 52 by means of the pins 80. The styling means 72 is comprised of the cooling member 82 and the boundary rib 78 surrounding the cooling member 82 at least in an area thereof. Disposed between the heating portion 52 and the cooling member 82 is a pressure-generating means in the form of the clamp 84. This clamp 84 has its forward and rearward end pivotally mounted in the cooling member 82 by means of a pivot pin. In this arrangement, the pivot axis 86 lies in the plane of symmetry 87 of the heating portion 52 and the styling means 72. The styling edges 88 are recognizable at the two lateral ends of the arcuate clamp 84.

Figure 11:
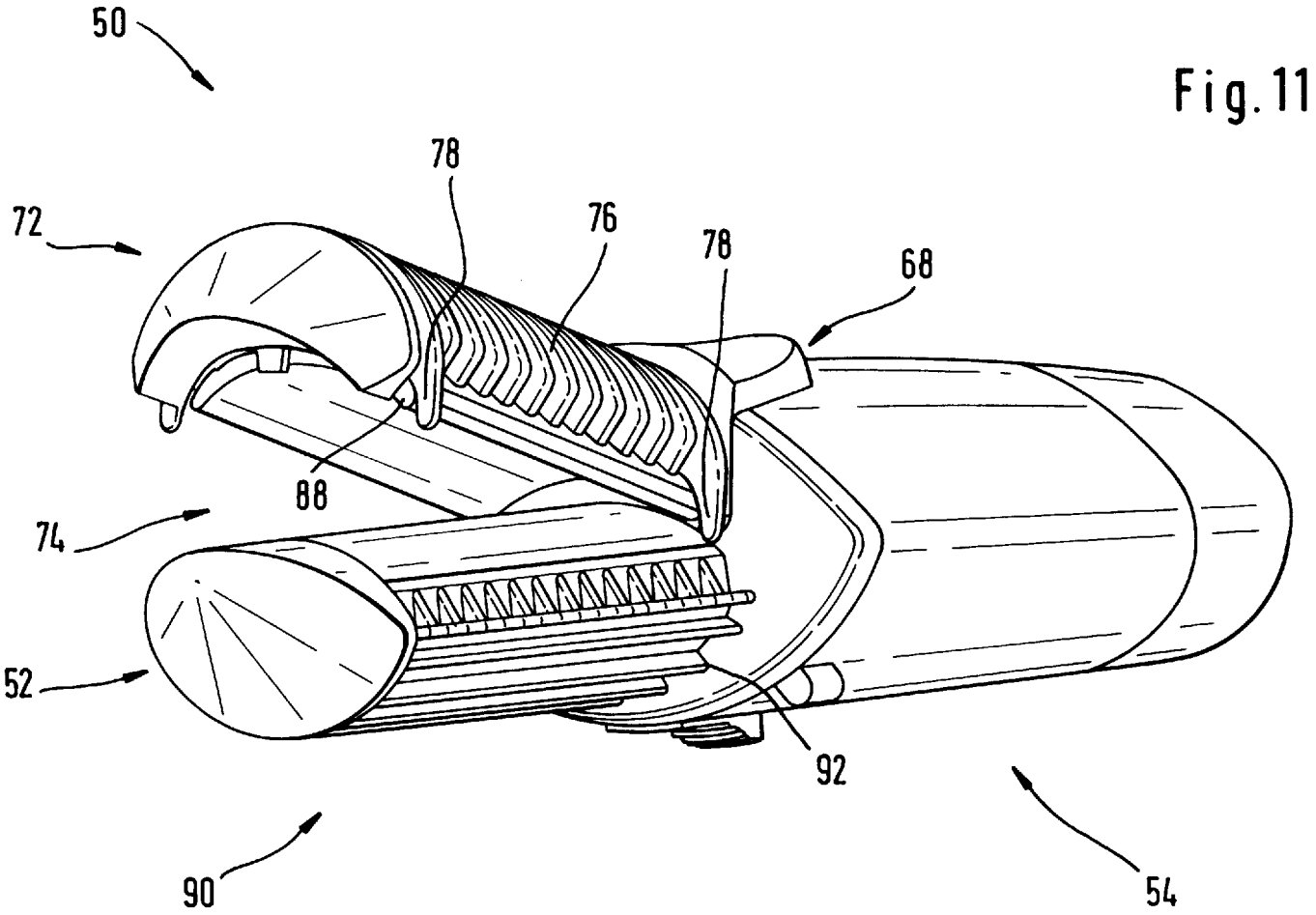
FIG. 11 is a perspective view of a hair styling appliance.

The hair styling appliance 50 (FIG. 11) is essentially comprised of a rearward handle portion 54 and a forward portion 90 adapted to be subdivided into the heating portion 52 and the styling means 72. At its rear end, the heating portion 52 is fixedly connected with the handle portion 54, while the styling means 72 has its rear end pivotally mounted on the handle portion 54. On operation of the control 68 on the upper side of the appliance 50, the parting line 74 between the heating portion 52 and the styling means 72 opens an amount sufficient to provide a wedge-shaped opening in which the hair to be shaped may be received comfortably. For shaping the hair, the styling means 72 is pivoted back onto the heating portion 52 by means of the control 68, causing the hair caught therebetween to be urged against the upper side of the heating portion 52. The boundary ribs 78 of the styling means 72 extend beyond the styling edge 88 in tooth shape, thus retaining the hair to be shaped within the area of the styling means 72 provided with the ribs 76 on its outside. In use of the hair styling appliance 50, the hair to be styled is thus drawn through the area between the heating portion 52 and the styling means 72, then deflected on the styling edge 88, and directed back over the outside of the styling means 72.

Figure 12:
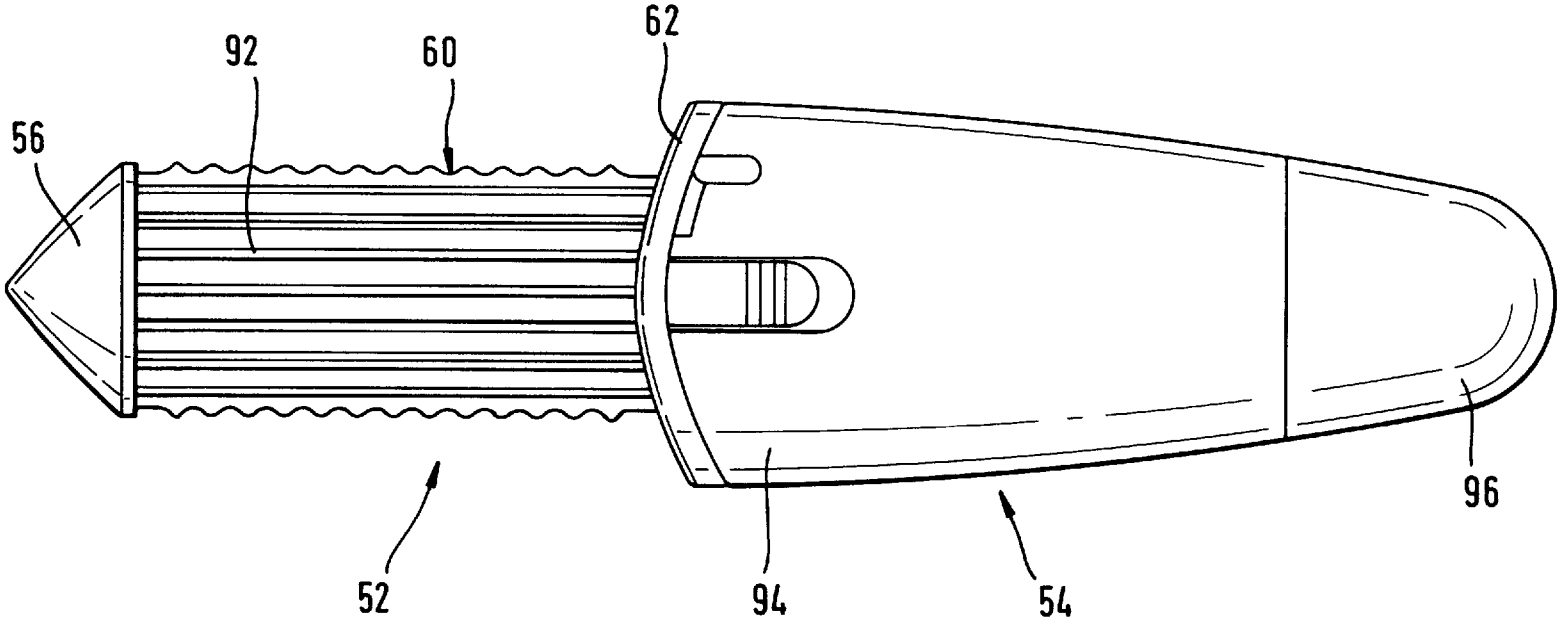
FIG. 12 is a bottom view of a hair styling appliance of FIG. 11.

In an alternative to the configuration of the ribs 58 shown in FIGS. 5 to 10, the heating portion 52 (FIG. 12) is provided with longitudinal ribs 92 on its outside. These are disposed between the tip 56 and the forward cover 62 of the appliance and are intended to prevent the user from wrapping a strand of hair about the forward portion 90 of the hair styling appliance. The handle portion 54 has a rear end cap 96 and a forward end 94.

Figure 5:
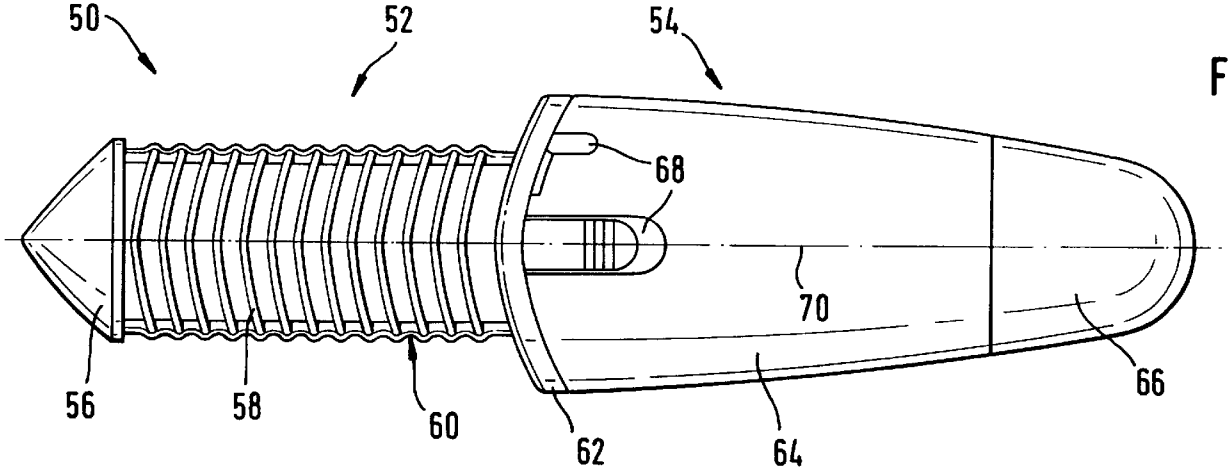
FIG. 5 is a bottom view of a hair styling appliance showing a handle portion and a heating portion.
Figure 13:
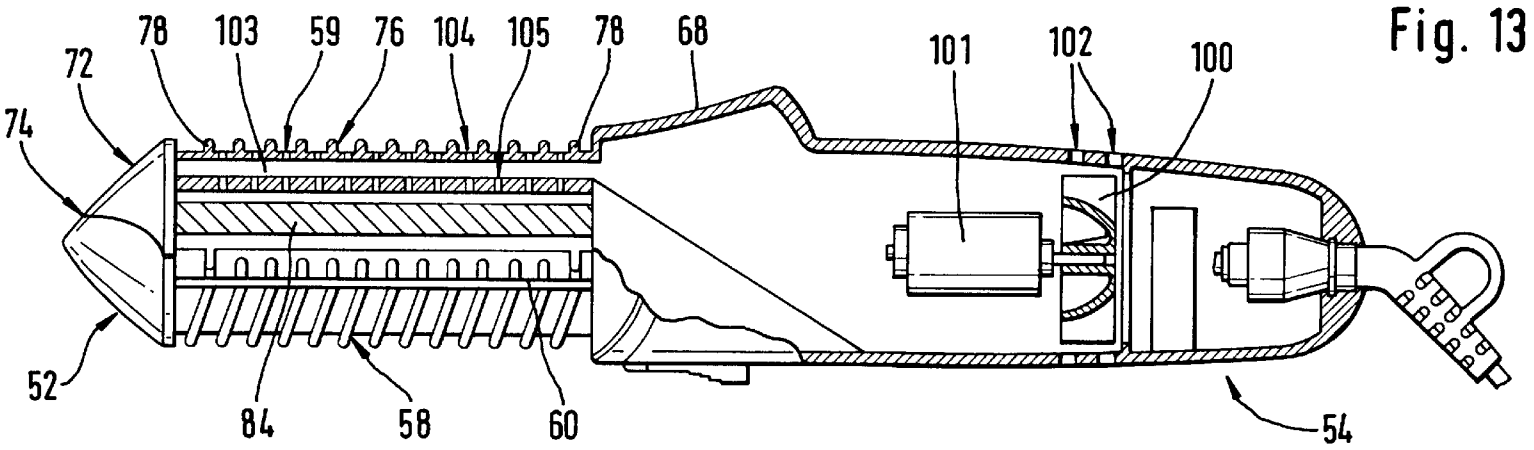
FIG. 13 is a side cut-away schematic view of an alternate embodiment wherein the cooling member contains a cooling air element.
Figure 14:
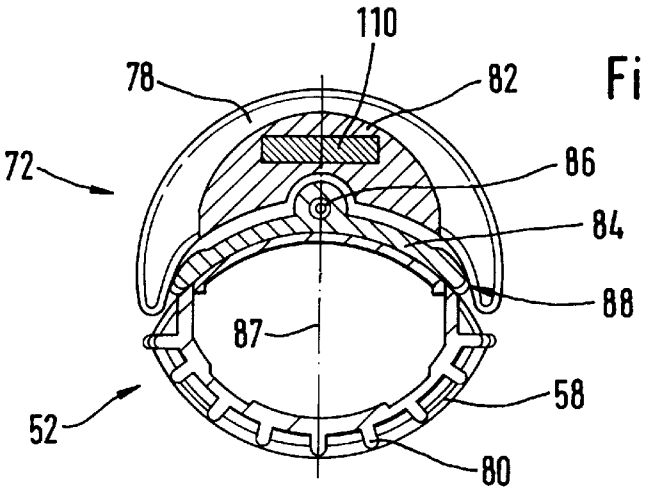
FIG. 14 is a sectional view of an alternate embodiment wherein the cooling member contains a Peltier element.

In an alternate embodiment of the device of FIG. 5, shown in cut-away schematic view in FIG. 13, cooling member 82 is supplied with cooling air generated in handle portion 54 by motor 101 and fan 100 drawing air from air inlet 102 into hollow passageway 103 to air outlets 104, 105. In another alternative embodiment of the device of FIG. 5, as shown in section in FIG. 14, cooling member 82 contains Peltier element 110.

We claim:

1. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body adapted to absorb heat from the styled hair strand and having a first surface in facing relation to said hair heating surface and a second surface facing at least partially away from said first surface, said second surface in operation at a lower temperature than said hair heating surface and adapted to absorb heat from the heated styled hair strand exiting continuously away from the hair heating surface, a clamp arranged between the heat absorbing body and the heating portion, said clamp being in opposed relation adjacent the heating portion and defining therebetween along a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curved shape towards the second surface of said heat absorbing body, wherein central portions of the clamp between the first and second longitudinal margins and the hair heating surface extend in adjacent mutually facing relation for guiding in a narrow transversely extending channel the transiting hair strand received therebetween and uniformly positioning the received strand of hair in said first direction contacting the hair heating surface, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape.

2. A hair forming appliance according to claim 1, wherein a ridge radius inscribed at a tip of the hair forming ridge is greater than about 0.1 mm.

3. A hair forming appliance according to claim 2, wherein the ridge radius is between about 0.5 mm and about 5 mm.

4. A hair forming appliance according to claim 2, wherein the ridge radius is greater than about 5 mm.

5. A hair forming appliance according to claim 1, wherein the hair forming ridge in cross-section comprises a curved shape.

6. A hair forming appliance according to claim 1, wherein the hair forming ridge in cross-section intersects a radius.

7. A hair forming appliance according to claim 1, wherein the hair forming ridge in cross-section further comprises polygonal segments.

8. A hair forming appliance according to claim 1, wherein the hair forming ridge extends generally parallel to the longitudinal axis.

9. A hair forming appliance according to claim 1, wherein the clamp further comprises the hair forming ridge formed adjacent the longitudinal margin directing the hair away from contacting relation with the heating portion.

10. A hair forming appliance according to claim 1, wherein the clamp is movably mounted on one of the handle and the heating portion.

11. A hair forming appliance according to claim 1, wherein the heating portion further comprises the hair forming ridge.

12. A hair forming appliance according to claim 11, wherein in cross-section opposed flanks defining the hair forming ridge include an angle less than 90°.

13. A hair forming appliance according to claim 11, wherein the heating portion in cross-section comprises a non-circular curvilinear shape.

14. A hair forming appliance according to claim 11, wherein the heating portion in cross-section comprises at least partially an ellipse.

15. A hair forming appliance according to claim 11, wherein the heating portion in cross-section comprises a droplet shape.

16. A hair forming appliance according to claim 1, further comprising a hair forming housing, said hair forming housing accommodating the clamp and the heat absorbing body.

17. A hair forming appliance according to claim 16, wherein the clamp further comprises the hair forming ridge.

18. A hair forming appliance according to claim 16, wherein the heating portion and the hair forming housing have respective first and second cross sectional areas, said first and second cross sectional areas collectively being less than a handle cross sectional area in a region proximate the handle connecting the heating portion.

19. A hair forming appliance according to claim 16, wherein the hair forming housing is movably mounted on one of the handle and the heating portion.

20. A hair forming appliance according to claim 19, wherein the hair forming housing is pivotally mounted.

21. A hair forming appliance according to claim 1, wherein the heat absorbing body is adjacent the hair forming ridge.

22. A hair forming appliance according to claim 1, wherein the hair forming ridge extends parallel to the heating portion longitudinal axis.

23. A hair forming appliance according to claim 1, wherein the heat absorbing body extends parallel to the heating portion longitudinal axis.

24. A hair forming appliance according to claim 1, wherein the heat absorbing body extends in spaced relation to the heating portion.

25. A hair forming appliance according to claim 1, wherein the heat absorbing body comprises aluminum.

26. A hair forming appliance according to claim 1, wherein the heat absorbing body further comprises a heat conductive coating.

27. A hair forming appliance according to claim 1, wherein a cross sectional area of the handle decreases from a region proximate the handle connecting the heating portion to a handle free end remote from the handle connecting the heating portion.

28. A hair forming appliance according to claim 1, wherein the heat absorbing body second surface operating temperature is at least about 35° C. less than that of the hair heating surface.

29. A hair forming appliance according to claim 1, wherein the clamp is biased by a spring towards the hair heating surface.

30. A hair forming appliance according to claim 1, wherein the hair forming ridge is formed at a peripheral margin of at least one of the heating portion and the clamp.

31. A hair forming appliance for styling hair of a user, comprising:

a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, wherein the heat absorbing body is hollow and contains paraffin, and a hair forming ridge adjacent the hair heating surface for directing the hair in a second direction relative to the hair pressed against the hair heating surface to deform the heated hair, wherein the clamp is arranged between the heat absorbing body and the heating portion, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

32. A hair forming appliance for styling hair of a user, comprising: a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, wherein the heat absorbing body further comprises a plurality of heat conducting fins along an external surface thereof, and a hair forming ridge adjacent the hair heating surface for directing the hair in a second direction relative to the hair pressed against the hair heating surface to deform the heated hair, wherein the clamp is arranged between the heat absorbing body and the heating portion, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

33. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body having a first surface in facing relation to said hair heating surface and a second surface facing at least partially away from said first surface, said second surface adapted to absorb heat from the heated styled hair strand, a clamp arranged in opposed relation adjacent the heating portion and defining therebetween along a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curved shape towards the second surface of said heat absorbing body, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape, and wherein the heat absorbing body is formed at least partially hollow and defines an air passageway therethrough, and the handle further comprises an air inlet, an air-moving fan and an air outlet in communication with the air passageway.

34. A hair forming appliance for styling hair of a user, comprising:

a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, wherein the heat absorbing body further comprises a Peltier-element, and a hair forming ridge adjacent the hair heating surface for directing the hair in a second direction relative to the hair pressed against the hair heating surface to deform the heated hair, wherein the clamp is arranged between the heat absorbing body and the heating portion, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

35. A hair forming appliance for styling hair of a user, comprising: a handle, a heating portion connected to the handle having a longitudinal axis and having a hair heating surface for transferring heat to a strand of hair to be styled into a curved shape as the hair heating surface is continuously pulled through the hair strand, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body operating at a lower temperature than the hair heating surface and having a surface adapted to absorb heat from the exiting hair, and a hair forming ridge adjacent the hair heating surface for directing the hair in a second direction relative to the hair pressed against the hair heating surface to deform the heated hair, wherein the clamp is arranged between the heat absorbing body and the heating portion, and wherein at least one of the heat absorbing body and the heating portion further comprises a plurality of spaced ribs on an exterior surface thereof, said ribs extending radially more outward than adjacent regions of the exterior surface, whereby when the user pulls the heating portion through the strand of hair away from the hair roots towards the hair tips, the hair strand transiting between the clamp and the hair heating surface is positioned by the clamp against the hair heating surface, the heated strand of hair exiting the hair heating surface is styled by the hair forming ridge, and the strand of heated deformed hair extending away from the hair forming ridge extends transversely across the heat absorbing body and is cooled.

36. A hair forming appliance according to claim 35, wherein the heat absorbing body comprises transverse ribs spaced along the longitudinal axis and defining a plurality of spaced channels between adjacent ribs.

37. A hair forming appliance according to claim 35, wherein the heating portion comprises ribs transverse to the longitudinal axis.

38. A hair forming appliance according to claim 35, wherein the heating portion further comprises longitudinal ribs parallel to the longitudinal axis, said longitudinal ribs extending radially more outward than adjacent regions of the exterior surface.

39. A hair forming appliance according to claim 35, wherein each rib of at least a portion of the plurality of the ribs extends transverse to the longitudinal axis and at least partially away, in a direction of the longitudinal axis, from a transverse plane perpendicular to the longitudinal axis.

40. A hair forming appliance according to claim 39, wherein the ribs of the portion of the plurality of the ribs are arranged on the heating portion curved in the direction of the longitudinal axis.

41. A hair forming appliance according to claim 39, wherein the ribs of the portion of the plurality of the ribs are arranged on the heating portion arrow-shaped in the direction of the longitudinal axis.

42. A hair forming appliance for styling hair of a user, comprising:

a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, and a hair forming ridge adjacent the hair heating surface for directing the hair in a second direction relative to the hair pressed against the hair heating surface to deform the heated hair, wherein the clamp is arranged between the heat absorbing body and the heating portion, and wherein at least one of the heat absorbing body and the heating portion further comprises a plurality of spaced ribs on an exterior surface thereof, and wherein the heat absorbing body comprises transverse ribs spaced along the longitudinal axis and defining a plurality of spaced channels between adjacent ribs, wherein at least one of the transverse ribs most proximate the handle and most remote from the handle along the longitudinal axis extends in a circumferential direction greater than the remaining portion of the transverse ribs, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

43. A hair forming appliance according to claim 42, wherein each of the transverse ribs most proximate the handle and most remote from the handle extends in the circumferential direction greater than the remaining portion of the transverse ribs.

44. A hair forming appliance for styling hair of a user, comprising:

a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, and a hair forming ridge adjacent the hair heating surface for directing the hair in a second direction relative to the hair pressed against the hair heating surface to deform the heated hair, wherein the clamp is arranged between the heat absorbing body and the heating portion, and wherein at least one of the heat absorbing body and the heating portion further comprises a plurality of spaced ribs on an exterior surface thereof, and wherein the heat absorbing body comprises transverse ribs spaced along the longitudinal axis and defining a plurality of spaced channels between adjacent ribs, and wherein the heating portion further comprises on an exterior surface a plurality of spaced longitudinal ribs parallel to the longitudinal axis, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

45. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body having a first surface in facing relation to said hair heating surface and a second surface facing at least partially away from said first surface, said second surface adapted to absorb heat from the heated stvled hair strand, a clamp arranged in opposed relation adjacent the heating portion and defining therebetween along a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curved shape towards the second surface of said heat absorbing body, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape, and further comprising a hair forming housing, said hair forming housing accommodating the clamp and the heat absorbing body, wherein the clamp is mounted on the hair forming housing in pivotal relation to the heat absorbing body.

46. A hair forming appliance for styling hair of a user, comprising:

a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, a hair forming ridge adjacent the hair heating surface directing the hair in a second direction relative to the hair pressed against the hair heating surface to deform the heated hair, and a hair forming housing, said hair forming housing accommodating the clamp and the heat absorbing body, wherein the clamp is mounted on the hair forming housing in pivotal relation to the heat absorbing body, wherein a pivot axis of the clamp is parallel to a longitudinal axis of the heat absorbing body, and wherein the clamp is arranged between the heat absorbing body and the heating portion, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

47. A hair forming appliance for styling hair of a user, comprising:

a handle, a heating portion connected to the handle having a longitudinal axis and having a hair heating surface for transferring heat to a strand of hair to be styled, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, a heat absorbing body, a hair forming ridge adjacent the hair heating surface for directing the hair in a second direction relative to the hair pressed against the hair heating surface to deform the heated hair, and a hair forming housing, said hair forming housing accommodating the clamp and the heat absorbing body, wherein the clamp is mounted on the hair forming housing in pivotal relation to the heat absorbing body, wherein the clamp is symmetric about its pivot axis, and wherein the clamp is arranged between the heat absorbing body and the heating portion, whereby when the user pulls the heating portion through the strand of hair away from the hair roots towards the hair tips, the heated strand of hair exiting the hair heating surface is styled by the hair forming ridge, and the strand of heated deformed hair extending away from the hair forming ridge extends transversely across the heat absorbing body and is cooled.

48. A hair forming appliance for styling hair of a user, comprising:

a handle, wherein the handle in cross-section to its longitudinal axis has an oblong exterior surface, a heating portion connected to the handle having a longitudinal axis and having a hair heating surface for transferring heat to a strand of hair to be styled as the appliance is pulled through the hair and away from a scalp of the user, a clamp arranged in opposed relation adjacent the heating portion to receive the strand of hair transverse to the longitudinal axis between the clamp and the heating portion and to press the hair to be styled in a first direction contacting the hair heating surface, with said hair exiting away from the hair heating surface along a longitudinal margin between the clamp and the heating portion, and a heat absorbing body operating at a lower temperature than the hair heating surface and having a surface adapted to absorb heat from the exiting hair, wherein central portions of the clamp between its longitudinal margins and the hair heating surface extend in adjacent mutually facing relation for guiding in a narrow transversely extending channel the transiting hair strand received therebetween and uniformly positioning the received strand of hair in said first direction contacting the hair heating surface, and wherein at least one of the heating portion and the clamp further comprises a hair forming ridge adjacent the hair heating surface for directing the hair in a second direction relative to the hair pressed against the hair heating surface to form a curl in the heated hair, whereby when the user pulls the heating portion through the strand of hair away from the hair roots towards the hair tips, the heated strand of hair exiting the hair heating surface is curled by the hair forming ridge with a curl size determined by speed of the combing motion without rotating the handle about its longitudinal axis so that an orientation of the clamp, the hair heating surface and the hair forming ridge during operation relative to the transiting hair strand tends to be maintained.

49. A hair forming appliance according to claim 48, wherein the oblong exterior surface is elliptical.

50. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body having a first surface in mutually facing relation to said hair heating surface and a second surface facing at least partially away from said first surface, said second surface operating at a lower temperature than said hair heating surface and adapted to absorb heat from the heated styled hair strand, wherein the hair heating surface and the heat absorbing body second surface are oriented in generally the same direction, a clamp arranged in opposed relation adjacent the heating portion and defining therebetween along a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curved shape towards the second surface of said heat absorbing body, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape.

51. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body having a first surface in facing relation to said hair heating surface and a second surface facing at least partially away from said first surface, said second surface adapted to absorb heat from the heated styled hair strand, a clamp arranged in opposed relation adjacent the heating portion and defining therebetween along a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curvedshape towards the second surface of said heat absorbing body, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape, and wherein the clamp is mounted in pivotal relation to the heat absorbing body.

52. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body having a first surface in facing relation to said hair heating surface and a second surface facing at least partially away from said first surface, said second surface adapted to absorb heat from the heated styled hair strand, a clamp arranged in opposed relation adiacent the heating portion and defining therebetween along a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curved shape towards the second surface of said heat absorbing body, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape, and wherein the clamp is separate from the heat absorbing body.

53. A hair forming appliance for styling hair of a user into a curved shape as the appliance is drawn away from the scalp, comprising:

a handle, a heating portion connected to the handle having a longitudinal axis and having a hair heating surface for transferring heat to a strand of hair to be styled into the curved shape as the appliance is continuously pulled through the hair strand, a heat absorbing body having a first surface in facing relation to said hair heating surface and a second surface facing at least partially away from said first surface, said second surface adapted to absorb heat from the heated styled hair strand, a clamp arranged in opposed relation adjacent the heating portion and defining therebetween alone a first longitudinal margin a hair inlet for supporting the approaching moving hair strand to be styled into the curved shape to receive the strand of hair transverse to the longitudinal axis between the clamp and the heating portion and to press the hair to be styled in a first direction contacting the hair heating surface, with said hair exiting away from the hair heating surface along a second longitudinal margin between the clamp and the heating portion defining a hair exit for supporting the exiting moving hair strand to be formed into the curved shape towards the second surface of said heat absorbing body, and a hair forming ridge adjacent the hair heating surface for directing the moving hair strand in a second direction relative to the hair pressed against the hair heating surface to deform the heated hair, whereby when the user pulls the heating portion through the strand of hair away from the hair roots towards the hair tips, the heated strand of moving hair exiting the hair heating surface is styled by the hair forming ridge, is transferred to the heat absorbing body, and is cooled to set the curved shape, and wherein the hair forming ridge, in an outward direction away from a plane of symmetry through the heating portion longitudinal axis, is not coincident with a longitudinal margin of the heat absorbing body.

54. A hair forming appliance according to claim 53, wherein the hair forming ridge is further outward than the longitudinal margin of the heat absorbing body.

55. A method of styling a strand of hair of a user comprising the steps of:

providing a handle, a heating portion connected to the handle and having a longitudinal axis, and a clamp in opposed relation adjacent the heating portion, wherein at least one of the heating portion and the clamp further comprises a hair forming ridge, receiving the strand of hair between the clamp and the heating portion and in overlying relation across the hair forming ridge transverse to the longitudinal axis, clamping the received strand of hair towards the heating portion, heating the strand of hair to a hair styling temperature to soften the hair strand, drawing the clamp and heating portion relative to the hair strand away from the hair roots towards the hair tips thereby causing a portion of the hair strand to approach the heating portion, transferring the portion of the clamped heated hair strand moving relatively away from the heating portion to approach the hair forming ridge in a first direction, and bending, in response to the drawing step, the portion of the heated hair strand about the hair forming ridge in a second direction extending away from the hair forming ridge different from the first direction of the hair approaching the hair forming ridge, whereby the strand of hair bent about the hair forming ridge is at least partially stretched, thereby styling the hair strand.

56. A method according to claim 55, whereby the bending step further comprises the hair bent about the hair forming ridge being stretched at least about one percent on a side of the hair opposite the hair forming ridge.

57. A method according to claim 55, wherein the bending step further comprises stretching the hair on a side in cross-section adjacent the heating portion.

58. A method according to claim 55, wherein the bending step further comprises stretching the hair on a side in cross-section opposite the heating portion.

59. A method according to claim 55, further comprising step of applying a tensile force to the hair strand while drawing the clamp, and heating portion relative to the hair strand.

60. A method according to claim 55, wherein the step of drawing the clamp and heating portion relative to the hair strand is performed at a first speed to produce a first styled hair curl of a first diameter and performed at a second speed greater than the first speed to produce a second styled hair curl of a second diameter greater than the first diameter.

61. A method according to claim 55, wherein the hair strand of the user is initially straight.

62. A method according to claim 55, wherein the step of heating further comprises heating the hair strand to at least the hair glassy temperature $T_g$ of about 120° C. at 30% relative humidity.

63. A method according to claim 55, whereby the bending step further comprises the second direction forming an included angle of between about 5° and 180° with the hair approaching the hair forming ridge.

64. A method according to claim 63, wherein the included angle is less than about 90°, whereby the styled hair strand exiting away from the hair forming ridge has components of motion opposite to the hair strand approaching the hair forming ridge.

65. A method according to claim 55, wherein the step of providing further comprises providing a heat absorbing body and further comprising the step of drawing the styled hair exiting away from the hair forming ridge across the heat absorbing body, whereby the hair is cooled.

66. A method according to claim 65, wherein the step of drawing the hair across the heat absorbing body further comprises guiding a stretched side in cross-section of the hair opposite to an exterior surface of the heat absorbing body.

67. A method according to claim 65, wherein the heat absorbing body has a surface temperature of less than about 85° C.

* * * * *